US007990360B2

(12) United States Patent
Song et al.

(10) Patent No.: US 7,990,360 B2
(45) Date of Patent: Aug. 2, 2011

(54) BACKLIGHT ASSEMBLY AND DISPLAY DEVICE HAVING THE SAME

(75) Inventors: Si-Joon Song, Yongin-si (KR); Eun-Chae Jeon, Seoul (KR); Gi-Cherl Kim, Yongin-si (KR); Young-Keun Lee, Cheonan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 472 days.

(21) Appl. No.: 12/115,303

(22) Filed: May 5, 2008

(65) Prior Publication Data

US 2009/0091265 A1 Apr. 9, 2009

(30) Foreign Application Priority Data

Oct. 5, 2007 (KR) ..... 10-2007-0100490

(51) Int. Cl.
*G09G 3/36* (2006.01)

(52) U.S. Cl. ..... 345/102; 315/308; 315/309

(58) Field of Classification Search ..... 345/102; 315/185 R, 246, 250, 291, 307, 309, 308
See application file for complete search history.

(56) References Cited

U.S. PATENT DOCUMENTS

| | | | | |
|---|---|---|---|---|
| 5,829,878 | A * | 11/1998 | Weiss et al. | 374/163 |
| 6,400,102 | B1 * | 6/2002 | Ghanem | 315/291 |
| 6,690,121 | B1 * | 2/2004 | Weindorf | 315/247 |
| 7,208,713 | B2 * | 4/2007 | Ishiguchi | 250/205 |
| 7,319,298 | B2 * | 1/2008 | Jungwirth et al. | 315/307 |
| 7,728,808 | B2 * | 6/2010 | Kim | 345/102 |
| 2007/0064421 | A1 * | 3/2007 | Baba | 362/231 |
| 2008/0079371 | A1 * | 4/2008 | Kang et al. | 315/309 |
| 2010/0259182 | A1 * | 10/2010 | Man et al. | 315/250 |

FOREIGN PATENT DOCUMENTS

KR 1020000024850 5/2000

* cited by examiner

*Primary Examiner* — Thuy Vinh Tran
(74) *Attorney, Agent, or Firm* — F.Chau & Associates, LLC

(57) ABSTRACT

A backlight assembly a plurality of first light-emitting chips for emitting light and a thermistor for indicating the temperature of the first light-emitting chips. The first light-emitting chips emit first color light and are connected in series to each other. The thermistor may be connected in series to the first light-emitting chips and has an electrical resistance that decreases with an increase of its temperature. The light amount emitted by the first light-emitting chips is controlled by pulse width modulating the current driving the first light-emitting chips based on the temperature (resistance) of the thermistor and based on received image data. Thus, a decrease in brightness due to temperature variation may be compensated for while performing color dimming.

16 Claims, 5 Drawing Sheets

BACKLIGHT ASSEMBLY AND DISPLAY DEVICE HAVING THE SAME

CROSS-REFERENCE TO RELATED APPLICATIONS

This application claims priority, under 35 USC §119, of Korean Patent Application No. 2007-100490 filed on Oct. 5, 2007 in the Korean Intellectual Property Office (KIPO), which is incorporated by reference herein in its entirety.

BACKGROUND OF THE INVENTION

1. Field of the Invention

The present invention relates to a backlight assembly and a display device having the backlight assembly. More particularly, the present invention relates to backlight assembly capable of controlling light-emitting elements (diode chips) for color-specific dimming and a display device having the backlight assembly.

2. Description of the Related Art

Liquid crystal display (LCD) devices typically include a backlight assembly for providing white light to pass through the LCD layer and color filters of the display device so that the display device may display an image. Examples of a white light source that may be used for the backlight assembly include a cold cathode fluorescent lamp (CCFL), a plurality (array) of light-emitting diodes (LED), etc.

Originally, a conventional backlight assembly for an LCD display continuously generates light while a power source is applied to the backlight assembly, without being synchronized with the image displayed. However, active research has been conducted on dimming-type backlight assemblies controlling brightness depending on the brightness of a displayed image in order to improve the power consumption of a backlight assembly and the image contrast.

Conventional methods of dimming a backlight assembly now include a 0-dimensional (0-D) dimming method, a 1-dimensional (1-D) dimming method, and a 2-dimensional (2-D) dimming method, etc. The 0-D dimming method controls (dynamically varies) the brightness of the entire display screen. The 1-D dimming method controls (dynamically varies) the brightness of each line of a display screen. The 2-D dimming method, which is called local dimming, independently controls (dynamically varies) the brightness of each portion of a display screen.

As requirements for color reproduction are increasing, active research is being conducted in color dimming, that is, color-selective dimming. An optical feedback system for detecting and controlling the amounts of light exiting from each of a red LED, a green LED and a blue LED is required for performing the conventional color dimming. The feedback system requires a sensor, and a light sensor is generally used as the sensor.

The feedback system employing the light sensor receives light emitted from an LED to generate a voltage signal, and the feedback system uses the voltage signal as a feedback signal to control the LED. However, the red, green and blue LEDs have to hold their light emissions at a fixed level for the feedback system using the light sensor.

The brightness sensed by a light sensor provided for controlling local dimming may be varied depending on the image displayed, and the brightness and the color sensed by a sensor for color dimming may be varied depending on the image signal. The feedback system using the light sensor may not be easily implemented in the local dimming method or the color dimming method because of the requirement to hold light emissions at a fixed level.

SUMMARY OF THE INVENTION

Embodiments of the present invention provide backlight assemblies capable of performing 3-dimensional (3-D) color dimming with accurate colors.

Other embodiments of the present invention provide display devices including backlight assemblies capable of performing 3-dimensional (3-D) color dimming with accurate colors.

One aspect of the present invention provides a backlight assembly that includes a light source part and a power control (driving) part. The light source part includes a plurality of first light-emitting chips and a first variable resistance element (e.g., a thermistor). The first light-emitting chips emit first color light and are connected to each other in series. The first variable resistance element has an electrical resistance that varies depending on its temperature (e.g., while being at approximately the same temperature as the first light-emitting chips). The power control (driving) part controls light amounts emitted by the first light-emitting chips based on the electrical resistance of the first variable resistance element.

The light source part may further include a plurality of second light-emitting chips emitting second color light and being connected to each other in series, and a plurality of third light-emitting chips emitting third color light and being connected to each other in series.

For example, the power control (driving) part may include a temperature detection part and a dimming circuit part. The temperature detection part detects the temperature of the variable resistance element to detect the temperature of the light source part and outputs a temperature signal. The dimming circuit part compensates the first, second and third light-emitting chips for decreases in light efficiency due to a temperature increase in response to the temperature signal provided by the temperature detection part. The dimming circuit part generates a first pulse width modulation (PWM) dimming signal, a second PWM dimming signal, and a third PWM dimming signal based on the temperature signal for controlling light amounts emitted by the first, second and third light-emitting chips. The first second and third PWM dimming signal may be further based on a received image data signal externally provided, for color dimming.

The power control (driving) part may control the first, second and third PWM dimming signals to compensate for a variation of the temperature of the light source part.

Another aspect of the present invention provides a display device including: a plurality of first light-emitting diodes connected in series to each other; a plurality of second light-emitting diodes connected in series to each other; a plurality of third light-emitting diodes connected in series to each other; a thermistor having an electrical resistance that varies depending on its temperature, wherein the thermistor is proximate to the plurality of first light-emitting chips; and a power control (driving) part configured to pulse-width modulate a current supplied to drive the first light-emitting diodes, based upon the electrical resistance of the thermistor. In some exemplary embodiments of the invention, the thermistor may be connected in series with the plurality of first light-emitting chips. The thermistor is a negative temperature coefficient (NTC) type thermistor.

Another aspect of the present invention provides a display device that includes a plurality of light source parts, a power control (driving) part and a display panel part. The light source parts are arranged in an array configuration. Each light source part includes a plurality of first light-emitting chips connected in series to each other, a plurality of second light-emitting chips connected in series to each other, a plurality of third light-emitting chips connected in series to each other and a first variable resistance element. The first variable resistance element may be connected in series to the first light-emitting chips and has an electrical resistance that varies depending on a temperature. The power control (driving) part controls light amounts emitted by the first, second and third light-emitting chips by pulse-width modulating first, second and third currents driving the first, second and third light-emitting chips. The pulse-width modulation is based upon the temperature of the pulse-width light-emitting chips as indicated by at least the first variable resistance element. For example, the power control (driving) part may include a temperature detection part and dimming circuit part. The temperature detection part may detect the temperature of the light source part and output a temperature signal accordingly. The dimming circuit part may generate a first PWM dimming signal, a second PWM dimming signal and a third PWM dimming signal based on the temperature signal provided by the temperature detection part for compensating the first, second and third light-emitting chips for decreases in light efficiency and for controlling light amounts of the first, second and third light-emitting chips depending on received image data. According to the above, a decrease in brightness due to temperature variation may be compensated for while performing dimming such as color dimming.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the sizes and relative distances between components and the sizes of layers and regions may be exaggerated for clarity of illustration.

It will be understood that when an element or layer is referred to as being "connected to" another element or layer, it can be directly connected to the other element or intervening elements may be present. In contrast, when an element is referred to as being "directly connected to" or "directly coupled to" another element or layer, there are no intervening elements (except passive nodes/wires) present. Like numbers refer to like elements throughout. As used herein, the term "and/or" includes any and all combinations of one or more of the associated listed items.

It will be understood that, although the terms first, second, third etc. may be used herein to describe various elements, components, regions (segments), layers and/or sections, these elements, components, regions, layers and/or sections should not be limited by these numerical terms. These numerical terms are only used to distinguish one element, component, region (segment), layer or section from another region, layer or section. Thus, a first element, component, region (segment), layer or section discussed below could be termed a second element, component, region (segment), layer or section without departing from the teachings of the present invention.

The terminology used herein is for the purpose of describing particular embodiments only and is not intended to be limiting of the invention. As used herein, the singular forms "a," "an" and "the" are intended to include the plural forms as well, unless the context clearly indicates otherwise.

Embodiments of the invention are described herein with reference to illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

BRIEF DESCRIPTION OF THE DRAWINGS

The above features of the present invention will become readily apparent to persons skilled in the art by reference to the following detailed description when considered in conjunction with the accompanying drawings wherein.

DETAILED DESCRIPTION OF EXEMPLARY EMBODIMENTS OF THE INVENTION

Figure 1:
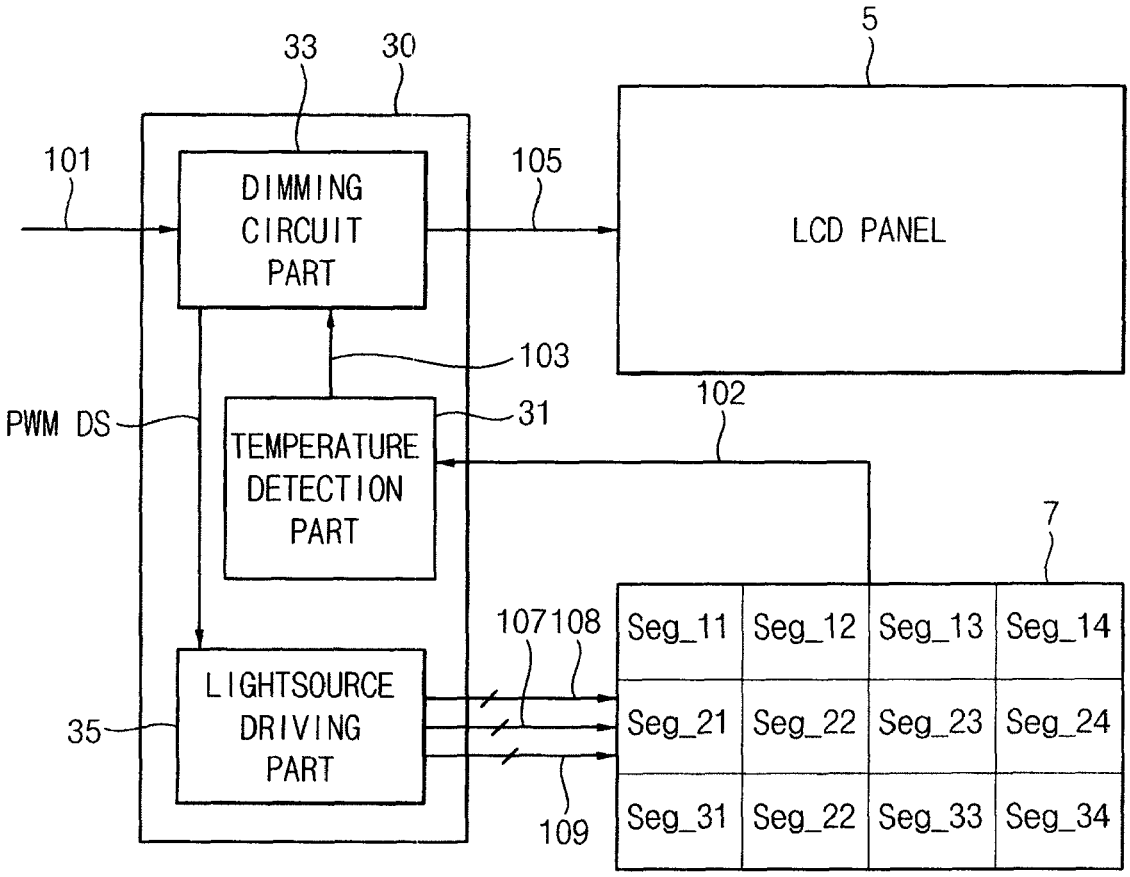
FIG. 1 is a block diagram of a display device 100 according to an exemplary embodiment of the present invention.
Figure 2:
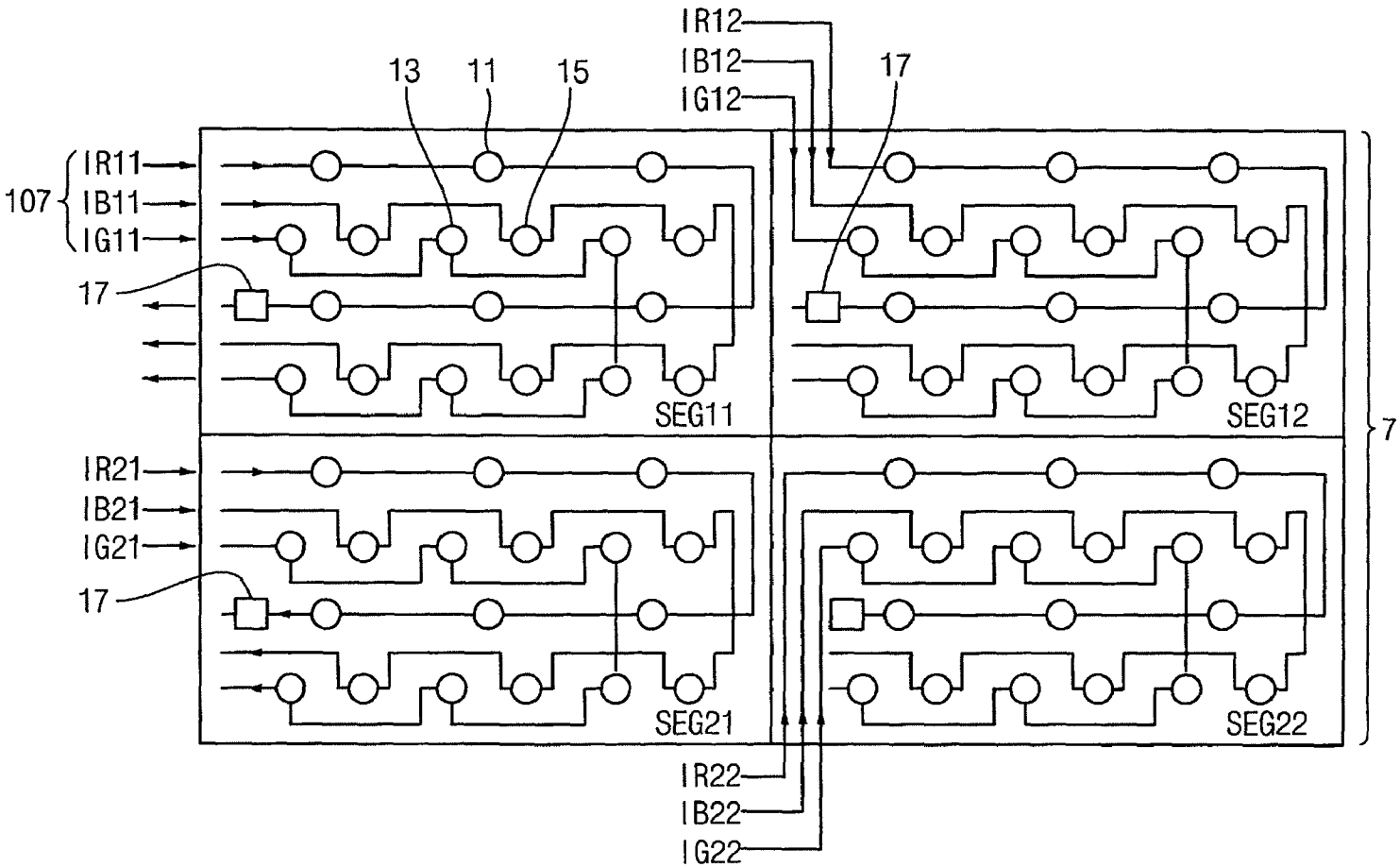
FIG. 2 is a plan view of a portion of the backlight assembly 7 of the display device 100 of FIG. 1 including four of the light source segments Seg_11, Seg_21, Seg_12, and Seg_22.

FIG. 1 is a block diagram of a display device according to an exemplary embodiment of the present invention. FIG. 2 is a plan view of a portion of the backlight assembly 7 of the display device of FIG. 1 including four of the light source segments Seg_11, Seg_21, Seg_12, and Seg_22.

Referring to FIGS. 1 and 2, a display device 100 includes a liquid crystal display (LCD) panel 5 and a backlight assembly 7 and a power control (driving) part 30.

The power control (driving) part 30 receives an external image data signal 101 to output a panel driving signal 105 including the image data. The LCD panel 5 displays an image in response to the panel driving signal 105 and light exiting from the backlight assembly 7 passes through the LCD panel 5.

The backlight assembly 7 emits light toward a rear surface of the LCD panel 5. The backlight assembly 7 includes a plurality of light source parts Seg_11. The light source parts may be shaped as a plurality of blocks and may be arranged to form a mosaic configuration or a matrix configuration disposed on the rear surface of the LCD panel 5. Each of the light source parts may be independently driven. The power control (driving) part 30 may control an amount and a color of light exiting from a light source part corresponding to the location of an image in response to the brightness and a color of the image. Thus, the backlight assembly may have a function of color dimming in response to the brightness and a color of the display panel 5.

Each of the light source segments includes a plurality of first light-emitting elements (e.g., semiconductor chips) 11, a first variable resistance element 17 mounted on a segment (area) of a printed circuit board (PCB).

Each of the first light-emitting chips 11 may include a light-emitting diode (LED) to emit first color light.

The PCB may include a metal layer, an insulation layer and power distribution lines 107, 108, and 109. The metal layer may transfer heat generated by each of the first light-emitting chips 11 outward. The insulation layer may be formed on the metal layer, and the power distribution lines 107, 108, 109 may be insulated by the insulation layer. The power distribution line 107 is electrically connected to each of the first light-emitting chips 11 in a segment of the backlight assembly 7 to provide the each of the first light-emitting chips 11 with driving power. The power distribution line 108 is electrically connected to each of the second light-emitting chips 13 to provide the each of the first light-emitting chips 13 in a segment of the backlight assembly 7 with driving power. The power distribution line 109 is electrically connected to each of the second light-emitting chips 15 to provide the each of the first light-emitting chips 15 in a segment of the backlight assembly 7 with driving power.

Each of the first light-emitting chips 11 may be disposed on the PCB according to a predetermined pattern. As illustrated in FIG. 2, each of the first light-emitting chips 11 may be connected in series to each other by metal wiring printed on the PCB.

The first variable resistance element 17 may include a semiconductor thermistor having characteristics where its resistance varies depending on its temperature. Examples of the thermistor include a negative temperature coefficient (NTC) type, a positive temperature coefficient (PTC) type and a critical temperature resistor (CTR) type depending on resistance and thermal characteristics.

For example, the NTC-type thermistor may be used for a feedback circuit to generate a feedback signal 102. The resistance of the NTC-type thermistor decreases as the temperature of the thermistor is increased. In an exemplary embodiment, the first variable resistance element 17 includes the NTC-type thermistor.

The first variable resistance element 17 is connected in series to each of the first light-emitting chips 11 which are connected in series to each other in the exemplary embodiment. Persons skilled in the art will recognize that the first variable resistance element 17 may be connected in series between any two of the first light-emitting chips 11. Alternatively, the variable resistance element 17 may be disposed adjacent to a power input terminal of each of the light source parts 7 or to a power output terminal of each of the light source parts 7. As illustrated in FIG. 2, the first variable resistance element 17 may be disposed adjacent to a power output terminal of each of the light source segments as in the exemplary embodiment shown in FIG. 2.

Each of the light source segments in the backlight assembly 7 may further include a plurality of second light-emitting chips 13 and a plurality of third light-emitting chips 15.

The second light-emitting chips 13 emit second color light, are connected in series and may be directly connected to each other. The third light-emitting chips 15 emit third color light, are connected in series and may be directly connected to each other.

Each of the first light-emitting chips 11, each of the second light-emitting chips 13 and each of the third light-emitting chips 15 may be disposed to correspond to each point of a triangular shape. When one of the first light-emitting chips 11, one of the second light-emitting chips 13 and one of the third light-emitting chips 15, are arranged in a triangular configuration, the cluster is defined as a light source unit, and a plurality of such light source units are disposed in the area of 2 rows and 3 columns, in each of the light source segments of the backlight assembly 7 as illustrated in FIG. 2.

The first light-emitting chips 11 are connected in series to each other, the second light-emitting chips 13 are connected in series to each other, and the third light-emitting chips 15 are connected in series to each other.

Alternatively, the first light-emitting chips 11, the second light-emitting chips 13 and the third light-emitting chips 15 may be variously arranged to form a light source unit. The plurality of light source segments in the backlight assembly 7 may be positioned adjacent to a rear surface of the display panel 5 while arranged in a predetermined configuration as explained above.

Each of the first light-emitting chips 11 may include a red light-emitting diode emitting red light, each of the second light-emitting chips 13 may include a green light-emitting diode emitting green light, and each of the third light-emitting chips 15 may include a blue light-emitting diode emitting blue light.

In the following exemplary embodiment, the first light-emitting chips 11 are red light-emitting chips, the second light-emitting chips 13 are green light-emitting chips, and the third light-emitting chips 15 are blue light-emitting chips.

The red, green and blue light emitted by the first, second, and third light-emitting chips may be mixed with each other to form white light. The first, second and third light-emitting chips 11, 13 and 15 may include light-emitting diodes emitting other colors of light, for example, yellow light, magenta light, etc., which are different from the red, green and blue light such that the red, green and blue light, but which may be mixed to form white light.

The LCD panel 5 displays an image using the white light emitted from the backlight assembly 7. The LCD panel 5 includes a liquid crystal layer, and the white light passes through pixels in the liquid crystal layer and through color filters at each pixel to display an image having predetermined colors. The brightness and the color of pixels in an image displayed on the LCD panel 5 depends on the quality of the white light output by the backlight assembly 7. Thus, the white light exiting from each of the light source segments of the backlight assembly 7 needs to have an accurate color-coordinate value so that the brightness and the colors of an image may be accurately displayed.

Figure 4:
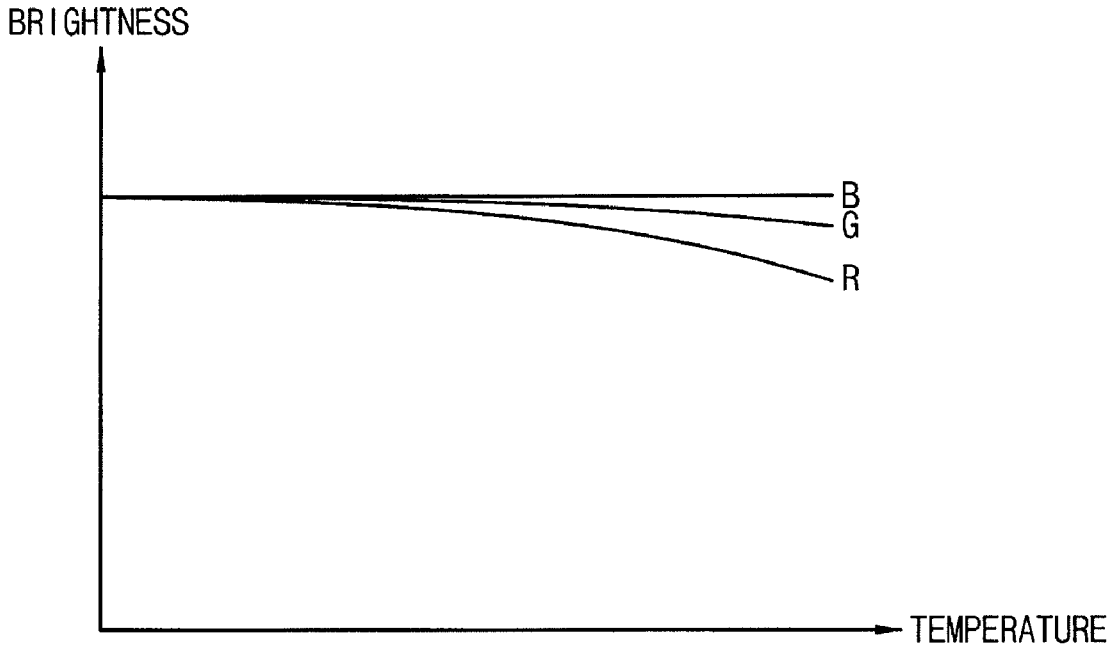
FIG. 4 is a graph illustrating the temperature-dependent variation of the brightness of a light-emitting chip in a segment of the backlight assembly 7 of the display device of FIG. 1.

FIG. 4 is a graph illustrating the brightness of a light-emitting chip in a segment of the backlight assembly 7 of the display device of FIG. 1 as a function of its temperature.

The red, green and blue light-emitting chips 11, 13 and 15 may respectively include a red LED, a green LED and a blue LED. When the red, green and blue light-emitting chips 11, 13 and 15 emit light, heat may be generated.

The PCB may dissipate the heat outward. Even if the PCB dissipates the heat outward, the temperatures of the PCB, the red light-emitting chips 11, the green light-emitting chips 13 and the blue light-emitting chips, (and of the variable resistance element 17 adjacent thereto) 15 may increase. Thus, as illustrated in the graph of FIG. 4, the light-emitting efficiencies of the red, green and blue light-emitting chips 11, 13 and 15 may be reduced, reducing the brightness of an image.

The green and blue light-emitting chips 13 and 15 may be formed of similar compounds, while the red light-emitting chips 11 may be formed of a compound different from those of the green and blue light-emitting chips 13 and 15. Examples of a compound that may be used for forming the red light-emitting chips 11 may include gallium aluminum arsenide (GaAlAs), indium gallium aluminum phosphide (InGaAlP), etc. Examples of a compound that may be used for the green and blue light-emitting chips 13 and 15 may include indium gallium nitride (InGaN), etc.

Since the red, green and blue light-emitting chips 11, 13 and 15 include different compounds, the red, green and blue light-emitting chips 11, 13 and 15 may have different brightness characteristics with respect to temperature as illustrated in FIG. 4. For example, the light-emitting efficiency of the red light-emitting chips 11 may be reduced more than the light-emitting efficiencies of the green and blue light-emitting chips 13 and 15 as the temperature is increased. The light-emitting efficiency of red light-emitting chips 11 depends on temperature more than do the green and blue light-emitting chips 13 and 15.

Thus, driving currents provided to each of the red, green and blue light-emitting chips 11, 13 and 15 need to be temperature-compensated differently so that the white light produced may maintain an accurate predetermined color-coordinate value. Thus, a feedback system accurately controlling the driving currents in response to a varying temperature is required. The feedback system needs to compensate the red light-emitting chips 11 more for a greater decrease in brightness due to an increase in temperature.

In an exemplary embodiment, the first variable resistance element 17 may provide feedback, which may control light exiting from each of the light source segments in the backlight assembly 7 without a separate light sensor for sensing the light emitted.

The power control (driving) part 30 may receive a feedback signal 102 corresponding to the varying amount of total voltage across the series circuit (hereinafter referred to as a red series circuit) including the red light-emitting chips 11 and the first variable resistance element 17. In alternative embodiments, the power control (driving) part 30 may receive a feedback signal 102 corresponding to the varying amount of total voltage across only the first variable resistance element 17.

The power control part (driving) 30 may control the amount of light emitted by the red light-emitting chips 11 in each light source segment by estimating the temperature increase in each of the light source segments by comparing previously saved data with the feedback signal 102. Thus, each of the light source segments may emit white light having a predetermined color-coordinate value.

The power control part (driving) 30 may independently control the amount of each light exiting from the red, green and blue light-emitting chips 11, 13 and 15 in each of the light source segments. Thus, each of the light source segments may emit white light or light having a color corresponding to a color of an image.

Referring to FIGS. 1 and 2, the power control (driving) part 30 may include a temperature detection part 31 and a dimming circuit part 33.

The temperature detection part 31 receives the feedback signal 102. The temperature detection part 31 may be electrically connected to a power input terminal and a power output terminal of the red series circuit, to measure the voltage across the red series circuit.

When the temperature of each of the light source segments is increased, the electrical resistance of the first variable resistance element 17 may be reduced. Thus, the total electrical resistance of the red series circuit may be reduced.

The power control (driving) part 30 provides the red series circuit with a uniform current for a predetermined time period. In view of Ohm's law that may be represented by V=IR, the voltage V supplied to the red series circuit is reduced as the temperature is increased because the total electrical resistance R of the red series circuit is reduced as the temperature is increased while the current I remains the same.

The temperature detection part 31 may detect the voltage (decrease) between the power input terminal 21 and the power output terminal 25 of the red series circuit, measuring the total voltage V across the red series circuit.

The temperature detection part 31 may include a comparing part and a temperature signal generating part.

The comparing part compares the voltage (decrease) between the power input terminal 21 and the power output terminal 25 with the previously saved data to generate a comparing signal. A specific voltage (drop) may correspond to a specific temperature according to the data.

Since each of the light source segments includes a portion of the PCB having a metal layer, each of the light source segments may achieve thermal equilibrium in a relatively short time. Thus, the red light-emitting chips 11, the green light-emitting chips 13, the blue light-emitting chips 15 and the first variable resistance element 17 may have substantially the same temperature.

Thus, the temperature signal generating part may provide the dimming circuit part 33 with a temperature signal 103 regarding the temperature of the red light-emitting chips 11 in response to the comparing signal provided by the comparing part. The temperature signal 103 may also include signals regarding the green and blue light-emitting chips 13 and 15.

For example, the dimming circuit part 33 may be electrically connected to or combined with the LCD panel driving part operating the LCD panel 5. The image data signal 101 is provided to the LCD panel 5 and to the dimming circuit part 33. The image data signal 101 includes data indicating the brightness (luminance) and the color (chrominance) of each pixel in an image.

The dimming circuit part 33 may analyze the image data signal 101 to generate a first pulse width modulation (PWM) dimming signal PWM_DS.

A PWM method provides a light-emitting chip with a pulsed current instead of a constant current, and varies the duty cycle (width) of each pulse with while the ON amplitude of the pulsed current is maintained constant in order to control the total amount of a current provided to the light-emitting chip during the period of each pulse. When color dimming is performed through the PWM method, the driving current though each of the red, green and blue light-emitting chips 11, 13 and 15 is controlled by a PWM dimming signal.

The dimming circuit part 33 may generate second and third PWM dimming signals based on the first PWM dimming signal and the temperature signal 103. For example, the dimming circuit part 33 may generate a first PWM dimming signal, a second PWM dimming signal and a third PWM dimming signal. The first PWM dimming signal may correspond to a light amount of the red light-emitting chips 11, and the second PWM dimming signal may correspond to a light amount of the green light-emitting chips 13, and the third PWM dimming signal may correspond to a light amount of the blue light-emitting chips 15. The first, second, and third PWM dimming signals may change pulse widths of driving currents for compensating for decreased brightness of the red, green and blue light-emitting chips 11, 13 and 15 respectively. Thus, a plurality of PWM dimming signals may be respectively generated for compensating the red, green and blue light-emitting chips 11, 13 and 15.

Figure 3:
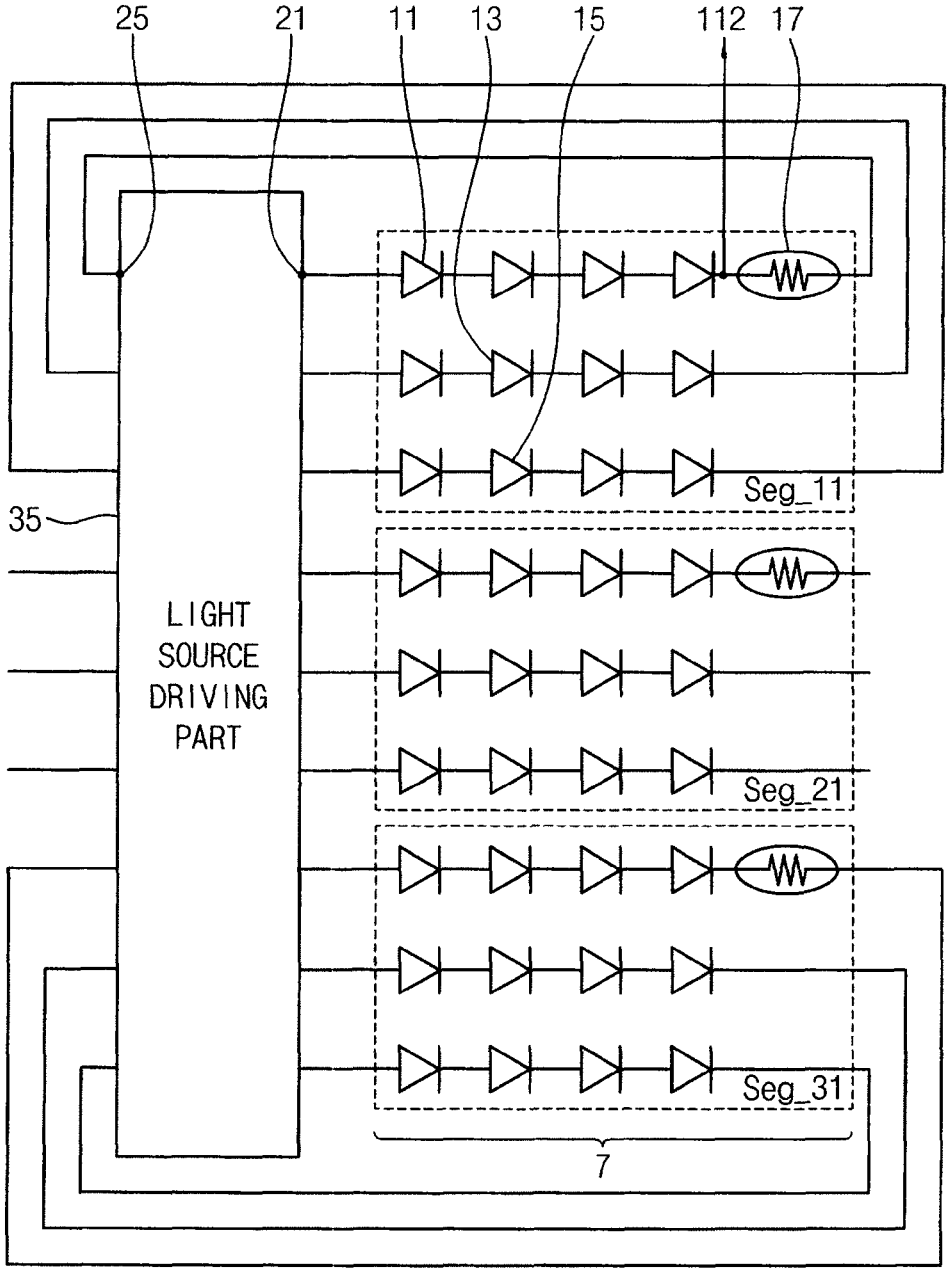
FIG. 3 is a block/circuit diagram of the light source driving part 35 and of three light source segments Seg_11, Seg_21, Seg_31 in the backlight assembly 7 of the display device of FIG. 1.

FIG. 3 is a detailed block diagram of the light source driving part and three light source segments in the backlight assembly 7 of the display device of FIG. 1.

Referring to FIGS. 1 and 3, the light source driving part 35 receives the first, second and third PWM dimming signals from the dimming circuit part 33.

The light source driving part 35 modulates the pulse width of a first driving current provided in response to the first PWM dimming signal to supply each of the red light-emitting chips 11 with a pulse-width modulated first driving current 107.

Furthermore, the light source driving part 35 may supply the green light-emitting chips 13 with a pulse-width modulated second driving current in response to the second PWM dimming signal. Similarly, the light source driving part 35 may supply each of the blue light-emitting chips 115 with a third pulse-width modulated driving current in response to the third PWM dimming signal.

As illustrated in FIG. 3, the light source driving part 35 may be connected by separate wires to the red series circuit, a series circuit (hereinafter referred to as a green series circuit) including the green light-emitting chips 13 and to a blue series circuit including the blue light-emitting chips 15.

Since the green and blue light-emitting chips 13 and 15 are formed of similar chemical compounds, the voltages applied to the green and blue light-emitting chips 13 and 15 may be substantially the same when the green and blue series circuits are provided with substantially the same current.

When the resistance of the first variable resistance element 17 is properly selected, and its temperature is substantially the same as the temperatures of the green and blue series circuits, the voltage applied to the red series circuit may be substantially the same as the voltages applied to the green and blue series circuits.

When the voltages of the red, green and blue series circuits are substantially the same having substantially the same current, circuit elements of the power control (driving) part 30 may be easily designed and manufactured.

A power input terminal and a power output terminal of each (red, green, or blue) series circuit are connected to the light source driving part 35. As explained above, the temperature detection part 31 may detect a voltage drop between the power input terminal 21 and the power output terminal 25 of the red series circuit.

The light source driving part 35 may include a plurality of driving circuits and a plurality of corresponding variable current source circuits.

The PWM dimming signal may serve as a gate signal applied to the gate electrode of a field effect transistor (FET e.g., PFET) in a driving circuit in the light source driving part 35. The source electrode of the FET may be electrically connected to driving a power supply voltage, and the drain electrode of the transistor may be electrically connected to each power input terminal (e.g., 21) of the red, green and blue series circuits. Alternatively, the PWM dimming signal may serve as a gate signal commonly applied to the gate electrodes of three field effect transistors (FETs e.g., PFETs) in the driving circuit in the light source driving part 35. The source electrode of the transistor may be electrically connected to a power supply voltage, and the drain electrodes of the three transistors may be electrically connected respectively to each power input terminal of the red, green and blue series circuits.

Figure 5:
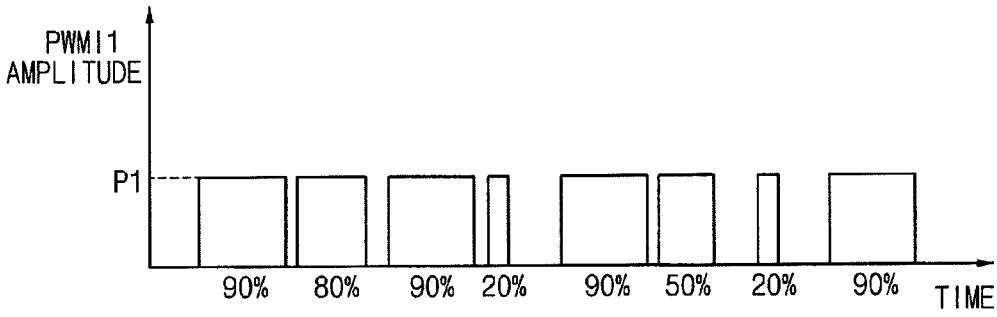
FIG. 5 is a waveform diagram illustrating a waveform of a pulse-width-modulated first driving current applied to the red light-emitting chips at a first temperature.
Figure 6:
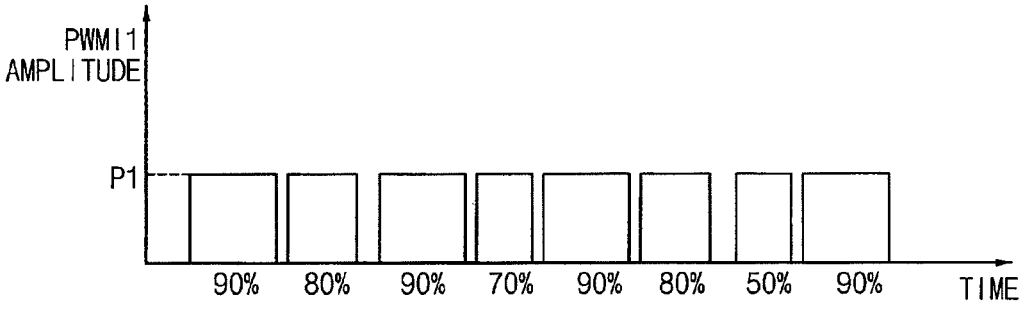
FIG. 6 is a waveform diagram illustrating a waveform of a pulse-width-modulated first driving current applied to red light-emitting chips at a second temperature.

FIG. 5 is a waveform diagram illustrating a waveform of a pulse-width-modulated first driving current applied to the red light-emitting chips of a segment of the backlight assembly 7 at a first temperature. FIG. 6 is a waveform diagram illustrating a waveform of a pulse-width-modulated first driving current applied to red light-emitting chips of a segment of the backlight assembly 7 at a second temperature.

Referring to FIGS. 5 and 6, the PWM dimming signal may be a pulse signal. Thus, the gate electrode of a transistor in a driving circuit in the light source driving part 35 may be linked to the PWM dimming signal to be alternately turned ON and OFF.

Accordingly, the first driving current 107 (FIG. 1) that is a pulsed current, modulated as illustrated in FIGS. 5 and 6, may be applied to the red series circuit.

Furthermore, the second driving current that is a pulsed current may be applied to the green series circuit, and the third driving current that is a pulsed current may be applied to the blue series circuit.

The variable current circuit of the light source driving part 35 may be linked with the PWM dimming signal to control the amount of the driving current or amplitudes of the first, second and third driving currents that are pulsed.

As each of the light source segments emit light, the temperature of each of the light source segment may increase from a first temperature to a second temperature. Comparing waveform diagrams of the first driving current 107 illustrated in FIGS. 5 and 6 with each other, the widths of pulses of the first driving current 107 at the second temperature may be increased compared to the widths of pulses of the first driving current 107 at the first temperature.

Thus, the current of each of the red light-emitting chips 11 at the second temperature may be increased so that the light output of the red light-emitting chips 11 at the second temperature may be substantially the same as the light output of the red light-emitting chips 11 at the first temperature. Thus, a voltage applied to the red light-emitting chips 11 in the red series circuit may be increased to be substantially the same as voltages applied to the green and blue series circuits. An increased width and a pattern of the pulse may be variously changed according to the first PWM dimming signal.

A pulse width of the second driving current applied to each of the green light-emitting chips 13 in response to the second PWM dimming signal and a pulse width of the third driving current applied to each of the blue light-emitting chips 15 in response to the third PWM dimming signal are may be varied depending on an increase in temperature of each of the light source segments.

Thus, a light amount output by each of red light, green light and blue light chips at the second temperature may be controlled to be the substantially the same as a light amount output by each of the red light, the green light and the blue light chips at the first temperature. Alternatively, the light amount output by each of the red light, the green light and the blue light at the second temperature may be controlled (varied) to be appropriate for color dimming.

Each of the light source segments may receive the first, second and third driving currents having pulse widths that are varied to compensate for temperature variations so that the brightness and color of an image at the first temperature are substantially the same as the brightness and color of the image at the second temperature. Thus, each of the light source segments at the second temperature will emit red light, green light and blue light having substantially the same light amounts (luminances) as at the first temperature.

Alternatively, when the brightness and a color of a first image at the first temperature are different from those of a second image at the second temperature, each of the light source parts 7 may receive the first, second and third driving currents that are compensated for temperature variation between the first and second temperatures and are appropriate for color dimming at the second temperature. Thus, each of the light source segments may emit red light, green light and blue light which having different light amounts.

In another exemplary embodiment, each of the light source segments may further include a second variable resistance element and a third variable resistance element. In this exemplary embodiment, the second variable resistance element may be connected in series with the second light-emitting chips emitting second color light and the third variable resistance element may be connected in series with third light-emitting chips emitting third color light, in order to accurately detect and compensate for temperature variation. The second variable resistance element may be connected in series to the green series circuit. The third variable resistance element may connected in series to the blue series circuit.

Thus, the power control (driving) part 30 may detect a variation of the amount of the voltage applied to the red series circuit including the first variable resistance element 17, a variation of the amount of the voltage applied to the green series circuit including the second variable resistance element and a variation of the amount of the voltage applied to the blue series circuit including the third variable resistance element.

The power control (driving) part 30 may control light amounts output by the red, green and blue light-emitting chips 11, 13 and 15 in response to the variation of the voltages, for color dimming in a method similar to the above.

A relatively inexpensive thermistor may be connected in series with light-emitting chips of each light source segment for detecting a temperature variation. Thus, variations of light amounts of the light-emitting chips may be controlled without sensing the light exiting from the light-emitting chips, and a feedback system for color dimming may be easily designed and constructed.

Although the exemplary embodiments of the present invention have been described, the present invention should not be limited to these exemplary embodiments and various changes and modifications can be made by persons ordinarily skilled in the art within the spirit and scope of the present invention as hereinafter claimed.

What is claimed is:

1. A backlight assembly comprising:

a plurality of first light-emitting chips for emitting first color light and connected in series to each other;

a plurality of second light-emitting chips for emitting second color light and connected in series to each other;

a plurality of third light-emitting chips for emitting third color light and connected in series to each other;

a first variable resistance element having an electrical resistance that varies depending on its temperature; and a power control part configured to control a light amount output by the plurality of first light-emitting chips by pulse-width modulating a first current through the plurality of first light-emitting chips based upon a detected temperature of the plurality of first light-emitting chips, which is detected by detecting the resistance of the first variable resistance element, wherein the power control part comprises:

a temperature detection part configured to detect the temperature of the plurality of first light-emitting chin and to output a temperature signal based on the detected temperature of the first light-emitting chips; and a dimming circuit part configured to generate a first pulse width modulation (PWM) dimming signal, a second PWM dimming signal and a third PWM dimming signal, based on the temperature signal and further based upon a received image data signal, for respectively controlling light amounts output by the plurality of first, second and third light-emitting chips.

2. The backlight assembly of claim 1, wherein the resistance of the first variable resistance element is detected based on a voltage across the first variable resistance element being fed back to the power control part as a feedback signal.

3. The backlight assembly of claim 1, wherein the first variable resistance element is connected in series with the plurality of first light-emitting chips, and wherein the temperature of the plurality of first light-emitting chips is detected by measuring the total voltage applied to the first light-emitting chips and to the first variable resistance element.

4. The backlight assembly of claim 1, wherein the temperature detection part includes:

a comparing part configured to generate a comparison signal based upon a comparison of a voltage that is a function of the detected temperature of the plurality of first light-emitting chips;

a temperature signal generating part configured to generate the temperature signal based upon the comparison signal.

5. The backlight assembly of claim 1, further comprising a light source driving part configured to generate a first driving current, a second driving current and a third driving current, which are pulsed based upon the first, second and third PWM dimming signals respectively, and to supply the first, second and third driving currents to the first, second and third light-emitting chips respectively.

6. The backlight assembly of claim 1, wherein the power control part controls the light amount emitted by each of the plurality of first, second and third light-emitting chips based on the image data signal, to emit mixed color light having a brightness corresponding to the brightness of a portion of an image corresponding to the location of the plurality of first, second and third light-emitting chips.

7. The backlight assembly of claim 1, wherein the power control part controls the light amount emitted by each of the first, second and third light-emitting chips based on a portion of the image data signal, to emit light having a color corresponding to the color of a portion of an image corresponding to the location of the plurality of first light-emitting chips, the plurality of second light-emitting chips and the plurality of third light-emitting chips.

8. The backlight assembly of claim 1, further comprising a second light source section that is independently driven.

9. A display device comprising:

a plurality of first light-emitting diodes connected in series to each other;

a plurality of second light-emitting diodes connected in series to each other;

a plurality of third light-emitting diodes connected in series to each other;

a first variable resistance element having an electrical resistance that varies depending on its temperature, wherein the first variable resistance element includes a thermistor proximate to the plurality of first light-emitting diodes; and a power control part configured to pulse-width modulate a current supplied to drive the first light-emitting diodes, based upon the electrical resistance of the thermistor, wherein the thermistor is connected in series with the plurality of first light-emitting diodes and the thermistor is selected to have a resistance characteristic such that a total voltage applied through the first light-emitting diodes is substantially the same during operation of the backlight assembly as the total voltage applied through the second light-emitting diodes and substantially the same as the total voltage applied through the third light-emitting diodes.

10. The display device of claim 9, wherein the power control part pulse-width modulates a second current supplied to drive the second light-emitting diodes and a third current supplied to drive the third light-emitting diodes, based upon the electrical resistance of the thermistor.

11. The display device of claim 9, further comprising:

a second thermistor connected in series to the second light-emitting diodes; and a third thermistor connected in series to the third light-emitting diodes.

12. The display device of claim 11, wherein the power control part includes:

a temperature detection part configured to output a temperature signal based upon detecting the temperature of the first variable resistance element; and a dimming circuit part configured to generate a first PWM dimming signal, a second PWM dimming signal and a third PWM dimming signal for controlling light amounts emitted by the plurality of first, second and third light-emitting diodes respectively, based upon the temperature signal and based upon received image data image.

13. The display device of claim 12, further comprising a light source driving part configured to generate a first driving current, a second driving current and a third driving current, that are pulsed according to the first, second and third PWM dimming signals respectively, and to provide the plurality of first, second and third light-emitting diodes with the first, second and third driving currents respectively.

14. A backlight assembly comprising:

a plurality of first light-emitting chips for emitting first color light and connected in series to each other;

a plurality of second light-emitting chips for emitting second color light and connected in series to each other;

a plurality of third light-emitting chips for emitting third color light and connected in series to each other;

a variable resistance element connected in series with the first light-emitting chips, wherein the element has an electrical resistance that varies depending on its temperature; and a power control part configured to detect a temperature based on a resistance of the element and control an amount of light output by the first light-emitting chips by pulse-width modulating a current through the first light-emitting chips based on the detected temperature; and a dimming circuit part configured to generate a first pulse width modulation (PWM) dimming signal based on a received image signal, and generate a second PWM dimming signal and a third PWM dimming signal based on the detected temperature and the first PWM signal, wherein the first, second, and third PWM signals are for controlling light amounts output by the first, second and third light-emitting chips, respectively.

15. The backlight assembly of claim 14, wherein the light-emitting chips are arranged in triangles such that all points of each triangle correspond to a light-emitting chip for emitting a distinct one of the colors.

16. The backlight assembly of claim 15, wherein the triangles are arranged into two rows and three columns.

* * * * *